United States Patent [19]

Siler

[11] Patent Number: 4,767,584

[45] Date of Patent: Aug. 30, 1988

[54] PROCESS OF AND APPARATUS FOR PRODUCING DESIGN PATTERNS IN MATERIALS

[75] Inventor: Todd L. Siler, Cambridge, Mass.

[73] Assignee: Massachusetts Institute of Technology, Cambridge, Mass.

[21] Appl. No.: 719,408

[22] Filed: Apr. 3, 1985

[51] Int. Cl.[4] ..... B29C 59/00; D06P 7/00

[52] U.S. Cl. ..... 264/78; 8/484; 8/486; 8/497; 68/205 R; 118/44; 118/58; 118/308; 118/315; 118/624; 264/24; 264/108; 264/131; 264/132; 264/136; 264/293; 425/3; 425/90; 425/385; 425/464; 427/198; 427/272; 427/276

[58] Field of Search ..... 264/24, 73, 74, 77, 264/78, 108, 131, 132, 134, 136, 245, 246, 247, 293; 425/3, 90, 174, 385, 464; 427/47, 197, 198, 271, 272, 275, 276, 280, 282, 288, 421; 26/69 R; 28/163; 118/44, 58, 301, 308, 313, 315, 624; 8/483, 484, 486, 487, 497, 498; 156/219, 234, 277; 68/205 R

[56] References Cited

U.S. PATENT DOCUMENTS

| | | | |
|---|---|---|---|
| 2,661,543 | 12/1953 | Tyndall et al. | 34/16 X |
| 3,378,935 | 4/1968 | Augere | 34/16 X |
| 3,432,376 | 3/1969 | Reed et al. | 156/234 |
| 3,502,495 | 3/1970 | Akamatsu | 8/497 X |
| 3,519,466 | 7/1970 | Akamatsu | 264/78 X |
| 3,523,152 | 8/1970 | Curtis | 264/246 |
| 3,619,866 | 11/1971 | Hofmann et al. | 425/3 |
| 3,696,780 | 10/1972 | Fritzsche | 118/301 X |
| 3,791,864 | 2/1974 | Steingroever | 427/47 |
| 3,865,540 | 2/1975 | Loeffler | 34/16 X |
| 3,867,299 | 2/1975 | Rohatgi | 425/3 X |
| 3,925,905 | 12/1975 | Zeiffer | 34/16 |
| 3,941,636 | 3/1976 | Drout et al. | 264/132 X |
| 3,953,654 | 4/1976 | Weidman | 264/78 |
| 3,986,274 | 10/1976 | Holm | 34/16 X |
| 4,033,153 | 7/1977 | Ahrweiler et al. | 68/205 R |
| 4,157,938 | 6/1979 | Clemens et al. | 34/16 X |
| 4,202,188 | 5/1980 | Gruber | 68/205 R |
| 4,297,099 | 10/1981 | Simon et al. | 8/484 |
| 4,388,137 | 6/1983 | McCarty et al. | 156/234 X |
| 4,438,570 | 3/1984 | Dokoupil | 34/16 X |
| 4,454,179 | 6/1984 | Bennett et al. | 156/234 X |
| 4,547,410 | 10/1985 | Panush et al. | 427/421 X |
| 4,576,020 | 3/1986 | Thurman et al. | 68/205 R |

FOREIGN PATENT DOCUMENTS

| | | | |
|---|---|---|---|
| 1006671 | 3/1977 | Canada | 264/247 |
| 3006604 | 8/1981 | Fed. Rep. of Germany | 264/22 |
| 3123102 | 12/1982 | Fed. Rep. of Germany | 8/484 |
| 53-41590 | 4/1978 | Japan | 8/486 |
| 53-149256 | 12/1978 | Japan | 264/132 |
| 55-49230 | 4/1980 | Japan | 264/132 |
| 1222744 | 2/1971 | United Kingdom | 427/197 |

OTHER PUBLICATIONS

Webster's New Collegiate Dictionary, G & C Merriam Co., 1981, p. 596.

*Primary Examiner*—Jeffery Thurlow
*Assistant Examiner*—Leo B. Tentoni
*Attorney, Agent, or Firm*—Robert F. O'Connell

[57] ABSTRACT

A process and system for providing a design pattern in a material wherein a seleced medium is applied to the material, the material being positioned adjacent a surface of a template which surface has selected surface characteristics either topographical or non-topographical in nature. The material is held against the template surface at a selected pressure and for a selected time period, at least a portion of the medium coming into contact with the template surface. The surface characteristics of the template interact with the material and the medium as the medium comes into contact with the surface to produce the desired pattern.

44 Claims, 1 Drawing Sheet

PROCESS OF AND APPARATUS FOR PRODUCING DESIGN PATTERNS IN MATERIALS

INTRODUCTION

This invention relates generally to processes for producing design patterns on materials and, more particularly, to a unique process for producing such design patterns using the surface characteristic of a template for interacting with such material and a medium applied thereto for a selected time period.

BACKGROUND OF THE INVENTION

The use of design patterns particularly on the surfaces of various materials, such as textiles, paper, and the like, has been achieved using various techniques over the centuries.

For example, one of the oldest methods of applying surface designs is the use of resist printing, early Japanese batiks and Japanese stencil prints being examples thereof, as well as plangi tie-dye techniques developed in Asia. Such techniques normally use an appropriate device to protect certain areas of the material so as to prevent color penetration in such areas, as from a dye. Other similar printing techniques have been developed such as stencil printing, screen printing, transfer printing and the like. Further the application of yarns and threads as a method of decorating fabrics has long been used as in the field of embroidery and tapestry, for example. Moreover, mechanical techniques such as embossing have also been used over the years. While those in the art have attempted to use the above well known techniques to produce different and dramatic design patterns and effects, the art is continually looking for ways of achieving further novel effects, particularly in the highly competitive field of fabric designs, (textile industry) and home furnishings, as well as in the paper products industry.

SUMMARY OF THE INVENTION

This invention can be used to provide noteworthy, imaginative and unique design patterns on various materials, such as metals, fabrics, paper, leather, wood, plastics, or other materials, in a manner which is novel to the art. In accordance therewith the material on which a design pattern is to be produced is positioned adjacent a surface of a template, the template having selected surface characteristics. The material is held against the template surface for a selected time period using a selected pressure which may be externally applied thereto or which may merely be due to the weight of the material itself. A medium such as an ink, dye or a paint, for example, is applied to selective portions of the exposed surface of the material and at least a portion of the medium is permitted to penetrate through the material to the surface which is adjacent the template surface. In such process the surface characteristics of the template interact with the material as the medium is being applied thereto and produces a design pattern in the material. If the medium is a wet medium, the material can then be dried, either by using natural air drying or by applying heat thereto, and the dried material can then be removed from the template.

Materials using such process have produced striking design pattern effects which provide an appearance quite unlike that achieved by known prior art processes.

BRIEF DESCRIPTION OF THE DRAWINGS

The invention can be described in more detail with the help of the accompanying drawings wherein.

DESCRIPTION OF THE PREFERRED EMBODIMENTS

Figure 1:
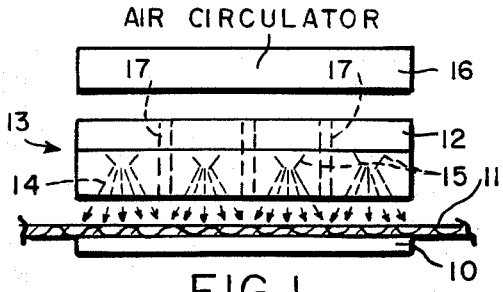
FIG. 1 shows a diagrammatic view of an embodiment of a device for practicing the process of the invention depicted at one stage of the process.
Figure 2:
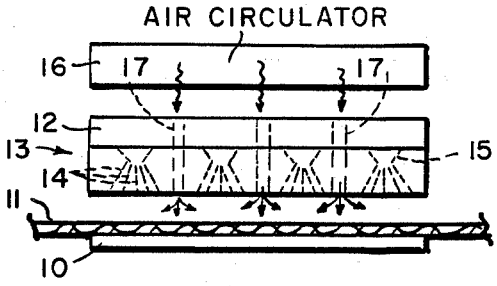
FIG. 2 shows the embodiment of FIG. 1 depicted at another stage of the process.
Figure 3:
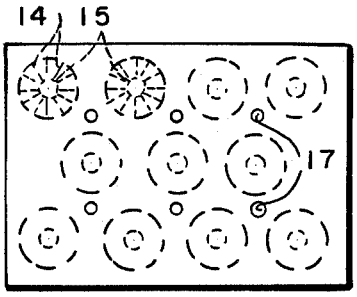
FIG. 3 shows a plan view of a portion of the embodiment of FIGS. 1 and 2 for applying the medium and for providing heat, if desired.
Figure 4:
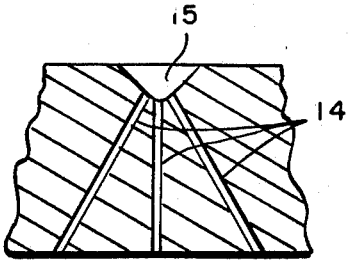
FIG. 4 shows a more detailed cross-sectional view of a portion of an exemplary manner for applying the medium in the embodiment of FIG. 1.

As can be seen in FIG. 1 the process of the invention can be illustrated most clearly using a simplified diagrammatic representation of a device for performing the process. Such an apparatus utilizes a substrate or template 10 on which is positioned a material 11 such as a fabric or textile material on which a design pattern is to be created. Such design pattern can be either random or non-random in nature and, if non-random, such pattern can be either abstract or representational. A resevoir 12 containing a suitable medium, such as a dye, an ink or a paint medium, can be applied to the exposed surface of material 11 opposite the surface adjacent template 10 via a suitable application means 13 which may include a plurality of channels 14, depicted more clearly in FIG. 4, which are supplied from the main reservoir 12 through individual reservoir cups 15 associated with each of the plurality of channels 14. In embodiments where the medium is a wet medium and it is desired that the finished product be dried reasonably quickly a suitable air circulator 16 can be used to apply either heated or unheated air to the material 11 via a plurality of channels 17 appropriately placed in the resevoir means 12 between the various media application channels, as shown in FIGS. 2 and 3.

In accordance with a preferred embodiment of the process of the invention the material 11 is positioned adjacent a surface of a template 10 as depicted in FIG. 1. Such material can be held against the template surface for a selected time period at a selectable pressure which can be either the pressure provided by the weight of the material itself or a controllable pressure which can be supplied externally in an appropriate manner. For example, in the particular embodiment shown in FIG. 1 air at a controllable pressure can be utilized from air circulator 16 so as to supply heated or unheated air under pressure through channels 17, the air then impinging upon the material at such a controllable pressure as to hold the material against the template 10 with a desired force. Other techniques for providing a controllable pressure as to hold the material against the template at a desired pressure can also be devised by those in the art. As discussed below, the amount of pressure used to hold the material against the template is an important parameter in affecting the variations in the design patterns which can be achieved. In addition, the time period which is selected is also an important parameter in affecting the variations in the design patterns which can be achieved.

While the material is being held against the surface of the template under the desired selectable pressure, a medium is applied to selected portions of the exposed surface of material 11 via selectively activated channels 14. Not all of the channels need be used and certain channel assemblies or certain channels within one or more of such assemblies can be selected for use in accordance with the process of the invention so as to create various design pattern effects.

At least portions of the medium which is applied to the exposed surface of material 11 are permitted to penetrate through the material to the opposite surface thereof which is adjacent template 10. Template 10 is provided with selectable surface characteristics, as discussed in more detail below. In accordance with such process it is found that the interaction of the selected surface characteristics of template 10 with the material held against the template surface for a selected time period under pressure as the medium is being applied thereto produces a striking and impressive design pattern effect on the surface of the material which is adjacent the template. Different pattern effects can be achieved using different material substrates, different template surface characteristics, different pressures of the material against the template, different time periods, and different media e.g. different types of either wet or dry media.

If the medium which is used is a wet medium, before removing material 11 from the surface of template 10, the material containing the medium which has been applied thereto is permitted to dry. Such drying process can be achieved by using a naturally circulating air current drying process, or an air circulator 16 can be utilized to apply heated or unheated air under pressure to the material 11 so as to dry it more quickly, as depicted in FIG. 2. Once the material is dry it can be removed from the surface of the template. Upon removal it is found that the surface that had been adjacent the template during the process now has a desired design pattern.

It should also be pointed out that once the material is dry, or even at any earlier point in the overall process, e.g., after the medium has been applied and before drying, it is possible to re-work the pattern that has been placed thereon by substituting a template having different surface characteristics, or a template having a smooth flat surface, and varying the media or pressures involved to create a further pattern which is superimposed upon or blended with the original pattern that has already been created. Accordingly, the original pattern can be suitably enhanced or further changed as desired either after the process has been completed or at some point during the process. For example, the original pattern can be built up (as in a low or shallow relief) to achieve a layered design pattern effect.

Details of a specific apparatus for performing the various steps of the design pattern producing process would be well within the skill of the art. For example, the design of media applicators and the use of heat sources for drying materials is well known to the art. It would also be within the skill of those in the art to provide an apparatus which permits the insertion and positioning of the material 11 against a template surface. Various techniques for holding the material against the template at a controllable pressure can also be devised by those in the art.

Figure 5:
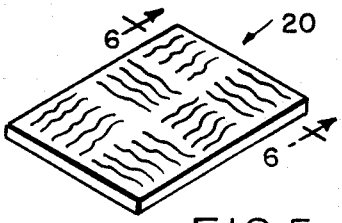
FIG. 5 shows an isometric view of a template used in the process of the invention.
Figure 6:
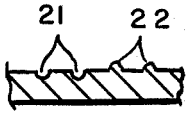
FIG. 6 shows a view in cross-section of a portion of the template of FIG. 5 along the line 6—6.
Figure 7:
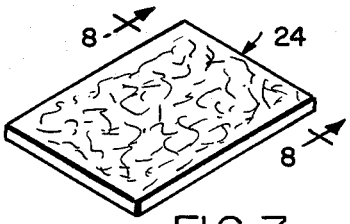
FIG. 7 shows an isometric view of another embodiment of a template used in the process of the invention.
Figure 8:
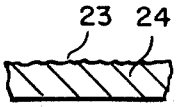
FIG. 8 shows a view in cross-section of a portion of the template of FIG. 7 along the line 8—8.

As can be perceived from the above description, the surface characteristics of the template represent a critical parameter in determining the design pattern that is obtained. Exemplary surface patterns are discussed below with reference to FIGS. 5–10. In FIG. 5, for example, a template 20 may have a surface thereof formed in a topographical pattern. Such pattern may be in the form of a regularized pattern as depicted, which pattern is formed utilizing a plurality of grooves 21 and protrusions 22 as shown more clearly in FIG. 6. Such a topographical pattern may also be formed in a random fashion utilizing an appropriate device for producing random indentations 23 in the surface of template 24 as shown in FIGS. 7 and 8. Further, such topographical patterns may be in a purposely designed artistic form which can be either abstract or representational in nature or combinations of both random or non-random patterns can be created by using different templates in succession as described above.

Figure 9:
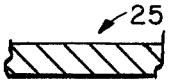
FIG. 9 shows a view in cross-section of another embodiment of a template having a different surface characteristic.

In some cases it may be desirable to use a non-topographical template surface characteristics such as shown by the template 25 of FIG. 9. It has been found that an appropriate plastic material, such as a clear polyethylene or a vinyl material, having a smooth surface can be used for the template. When the process is carried out, the interaction of the non-topographical surface characteristic of such a template with the material having the wet medium applied thereto tends to cause portions of the template surface to be removed when the material itself is removed therefrom, portions of such plastic template thereby being permanently bonded to the adjacent surface of the material on which the design pattern is to be formed. When the material is fully removed from contact with the template surface, imaginative and effective design patterns result from the presence of such permanently bonded portions. In such cases, the particular design pattern may not necessarily be predictable by the user but it has been found that many impressive and vivid design effects can be achieved using a suitable plastic material having smooth, or non-topographical, characteristics and being capable of such bonding operation. As discussed above, further or additional printing processes, i.e. using conventional techniques, can be applied to a design completed in accordance with the invention, thereby creating another different design made by using a combination of the techniques of the invention and conventional techniques.

Figure 10:
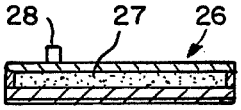
FIG. 10 shows a template utilizing magnetizable particles in its interior for providing selected surface characteristics thereof by computerized manipulation of the particles.
Figure 11:
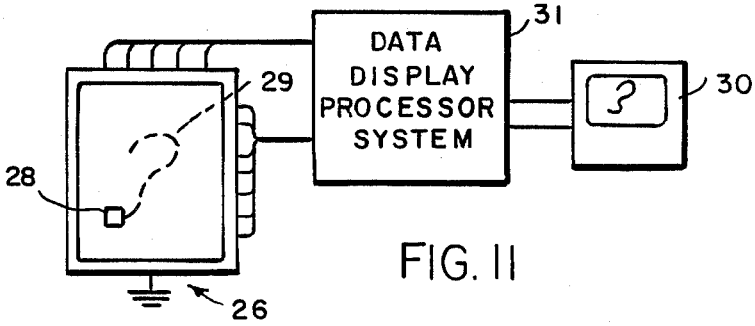
FIG. 11 shows a block diagram of an overall data processing system for use with the template of FIG. 10.

A further alternative embodiment for providing an effective design pattern is depicted in the template substrate 26 of FIG. 10. In such an embodiment a plastic or non-magnetizable material is utilized for the substrate itself and the interior 27 thereof is hollow. Magnetizable elements in the form of a magnetized filler material are placed within the interior 27 of the substrate. As shown in FIG. 11 a selected pattern of such magnetizable elements may be formed in the interior of template 26 by moving a magnet 28 over the surface thereof along a line which forms a desired pattern configuration, such as depicted by dashed line 29. The movement of the magnet causes the filler material to be aligned with such design pattern within the interior of template 26. The designer can display in real time, as he or she is creating the design, the pattern which is being formed on a suitable monitor screen 30 (e.g. a cathode ray tube) using a suitable data display processor system 31. For example, it would be well known in the display art to utilize an appropriate grid wire matrix, position sensing structure in association with the template for supplying data to the data display processor system which represents the position of the magnet as it is being moved on the surface of the tample. Such data can then be suitably processed so as to be displayed on screen 30 as shown. As mentioned above with respect to physically formed topographical template surfaces, the magnetic elements may be formed in random or non-random patterns, and, if non-random, may be arranged to produce either an abstract or a representational design pattern.

Once the magnetizable filler elements are arranged in a particular pattern within the substrate 26, a magnetized medium, which can be appropriately magnetized in accordance with well known techniques, is applied to the surface of the material 11. The medium is attracted to those regions of the substrate under which the desired pattern of magnetizable elements has been formed.

Moreover, the magnetizable particles can be used with non-magnetized media, e.g. regular dyes, paints, etc., by forming a pattern of such particles in a template having a very thin, flexible surface layer so that, when the material on which a design is to be created is held against such layer, the magnetizable particles form a topographical pattern on the thin layer surface for such purpose.

Other techniques for forming surface characteristics of the template substrate may also be devised by those in the art for use in the process of the invention and the above discussion of FIGS. 5–10 is intended to be exemplary thereof.

Figure 12:
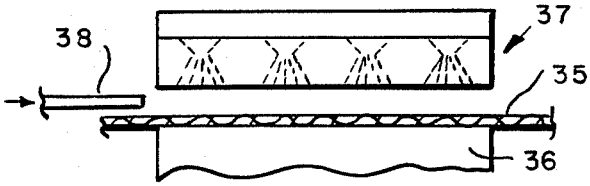
FIG. 12 shows a diagrammatic view of an alternative embodiment for practicing the process of the invention depicted in one stage of the process thereof.
Figure 13:
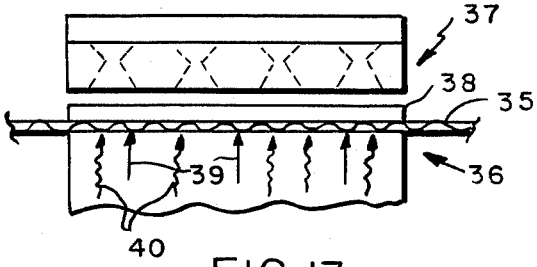
FIG. 13 shows the embodiment of FIG. 12 depicted at another stage of its process.

An alternative embodiment of the process of the invention is illustrated in FIGS. 12 and 13 wherein a medium is applied to the material substrate on which a pattern is to be formed prior to its being placed adjacent a template. As shown in FIG. 12, for example, a material 35 is placed on a suitable mounting structure 36 during an initial stage of operation and a medium is appropriately applied to the material via a suitable media application means 37 as discussed above. No template substrate 38 is present between the media application means and the material 35 or between the material and mounting structure 36 at such stage.

A template 38 can then be moved into position against the surface of material 35, an appropriate force (e.g. using a mechanical or fluid pressure techniques) being applied to the opposite side of material 35 as depicted by arrows 39 for holding the material against the substrate 38, as shown in FIG. 13. The surface characteristics of the template 38, as before, interact with the material 35 containing the medium which has been applied thereto so as to form a desired design pattern on the surface of the material which is adjacent the substrate. Appropriate drying may be achieved, as before, either by applying heated or unheated air (depicted by arrows 40) or by permitting the material to dry naturally. The material can then be removed from the template by moving the template out of its position away from the material and then removing the material from mounting structure 36.

As discussed above, the material utilized in the process of the invention can be selected from any materials on which a suitable design pattern effect can be obtained, such as textiles, fabrics (synthetic and natural), paper, leather and the like. Moreover, the medium utilized may be either in a wet form, such as an ink, a paint, a dye, etc., or it may be in a dry form, i.e., in a powder or other particulate form. The consistency of the medium may be as thick or as thin as desired and may be applied in a pressurized manner as by using a high pressure atomizer or a jet stream applicator or by using low pressure spray at any desired pressure. Alternatively it can be applied in a non-pressurized manner such as by merely letting the medium drip on to the surface of the material under gravity.

The template may be formed of a rigid material or it may be formed as a semi-rigid or flexible material and may be made of a suitable plastic, metal, wood, paper, or other suitable material.

As discussed above the surface characteristics of the template may be in the form of topographical characteristics or non-topographical characteristics. The template itself may have a thickness of any desired value, different effects being achieved depending on the selected thickness as well as on the selected topographical or non-topographical surface characteristics thereof.

The material may be held against the template for a selected time period and at a selected pressure, which characteristics can be selected over relatively wide ranges depending upon the design effects which are desired to be achieved. In some cases, as mentioned above, the mere weight of the material itself may be sufficient to provide the desired pressure.

As also mentioned above, drying may be achieved either naturally by merely utilizing naturally circulating air currents as at room temperature or by using an external air ciculator source to apply heated or unheated air, or other gas, to the material so as to dry it more quickly.

All of the above variations in the material, the medium, the template characteristics, the pressure against the template, the time period and the drying techniques used are well within the control of the user of the process and variations of one or more or all of such parameters can be used to achieve different design effects. The range of such designs is effectively unlimited and the technique of the invention can be experimented with by the user to determine which effect is the most effective for any particular application for which the material is to be used.

Hence, the invention is not to be limited to the particular embodiments discussed above except as defined by the appended claims.

What is claimed is:

1. A process for producing a design pattern in a material comprising the steps of applying a selected medium to selected portions of an exposed surface of a material in which said design pattern is to be produced;

positioning said material adjacent to a surface of a template having selected surface characteristics either before or after said medium has been applied to said material; and holding said material against said template surface, at a selected pressure provided either by the weight of said material or by an externally applied controllable pressure and for a selected time period, to bring at least a portion of said material and said medium into contact with said template surface, different pressures and time periods being selected so as to produce different design patterns on the surface of said material, which patterns differ from the surface characteristics of said template and wherein said different design patterns are produced as a result of at least said different selected pressures and time periods.

2. A process in accordance with claim 1 wherein said material is positioned adjacent said template surface before said medium has been applied to said material.

3. A process in accordance with claim 1 wherein said material is positioned adjacent said template surface after said medium has been applied to said material.

4. A process in accordance with claim 1 wherein said medium is applied in a wet form and further including the step of drying said material when said design pattern has been produced on the surface thereof.

5. A process in accordance with claim 4 wherein said drying step includes applying heated air to said material.

6. A process in accordance with claim 1 wherein said medium is applied in a dry form.

7. A process in accordance with claim 1 wherein said material is held against said template surface by applying an external force thereto.

8. A process in accordance with claim 1 wherein said material is held against said template surface by using its own weight to provide said pressure.

9. A system for producing a design pattern in a material, which pattern differs from the surface characteristics of a template means, comprising means for applying a selected medium to selected portions of an exposed surface of a material in which said design pattern is to be produced and which material is to be positioned adjacent to said template means; template means having selected surface characteristics formed on a surface thereof so that, when said material is positioned adjacent to and held against the surface of said template means, patterns can be produced on the surface of said material; means for positioning said material adjacent said surface of said template means either before or after said medium has been applied to said material; and means for holding said material against said template surface, at a selected pressure provided either by the weight of said material or by an externally applied controllable pressure and for a selected time period, to bring at least a portion of said material and said medium into contact with said template surface, different pressures and time periods being selected so as to produce different patterns on the surface of said material, which patterns differ from the surface characteristics of said template means and wherein said different design patterns are produced as a result of at least said selected pressures and time periods.

10. A system in accordance with claim 9 wherein said template surface has topographical surface characteristics.

11. A system in accordance with claim 10 wherein said topographical surface characteristics include surface characteristics which are random in nature.

12. A system in accordance with claim 10 wherein said topographical surface characteristics include surface characteristics which are non-random in nature.

13. A system in accordance with claim 12 wherein said non-random topographical surface characteristics include surface characteristics which are abstract in nature.

14. A system in accordance with claim 12 wherein said non-random topographical surface characteristics include surface characteristics which are representational in nature.

15. A system in accordance with claim 12 wherein said non-random topographical surface characteristics include surface characteristics which are both abstract and representational in nature.

16. A system in accordance with claim 9 wherein said template surface has non-topographical characteristics.

17. A system in accordance with claim 16 wherein said non-topographical surface characteristics include surface characteristics which are random in nature.

18. A system in accordance with claim 16 wherein said non-topographical surface characteristics include surface characteristics which are non-random in nature.

19. A system in accordance with claim 18 wherein said non-random non-topographical surface characteristics include surface characteristics which are abstract in nature.

20. A system in accordance with claim 18 wherein said non-random non-topographical surface characteristics include surface characteristics which are representational in nature.

21. A system in accordance with claim 18 wherein said non-random non-topographical surface characteristics include surface characteristics which are both abstract and representational in nature.

22. A system in accordance with claims 10, 15, or 16 wherein said template surface is formed of a selected substance such that, when said material is held against said surface for said interaction, portions of said substance are caused to become permanently bonded to said material.

23. A system in accordance with claim 22 wherein said selected substance is a synthetic polymer material.

24. A system in accordance with claim 23 wherein said synthetic polymer material is a polyethylene material.

25. A system in accordance with claim 23 wherein said synthetic polymer material is a vinyl material.

26. A system in accordance with claim 9 wherein said medium is selected so as to be in a wet form and said system further includes means for drying said material when said design pattern has been produced thereon.

27. A system in accordance with claim 26 wherein said drying means comprises air circulation means for directing circulating air on to said material.

28. A system in accordance with claim 27 wherein said air circulating means includes means for heating said circulating air.

29. A system in accordance with claim 9 wherein said medium is selected so as to be in a dry form.

30. A system in accordance with claim 9 wherein said holding means includes means for providing an external pressure on said material so as to hold it against said template surface at said selected pressure.

31. A system in accordance with claims 9 wherein said template means includes means for retaining magnetized particles capable of motion therein;

means for producing a controlled magnetic field operable to move said magnetized particles so as to form a selected pattern thereof in said template means;

said medium being magnetized so that when said medium is applied to said material said magnetized particles cause said medium to be attracted to said template surface so as to conform to said selected pattern.

32. A system in accordance with claims 9 wherein said template means includes means for retaining magnetized particles capable of motion therein;

means for producing a controlled magnetic field operable to move said magnetized particles so as to form a selected pattern thereof in said template means in contact with a surface of said template means so that said surface forms a topographical pattern conforming to said selected pattern of magnetized particles.

33. A system in accordance with claim 30 wherein said material is held against said template surface by using its own weight to provide said pressure.

34. A system in accordance with claim 31 wherein said material is positioned adjacent said template surface before said medium has been applied to said material.

35. A system in accordance with claim 31 wherein said material is positioned adjacent said template surface after said medium has been applied to said material.

36. A system in accordance with claim 32 wherein said material is positioned adjacent said template surface before said medium has been applied to said material.

37. A system in accordance with claim 32 wherein said material is positioned adjacent said template surface after said medium has been applied to said material.

38. A system in accordance with claim 22 wherein said template means includes means for retaining magnetized particles capable of motion therein;

means for producing a controlled magnetic field operable to move said magnetized particles so as to form a selected pattern thereof in said template means;

said medium being magnetized so that when said medium is applied to said material said magnetized particles cause said medium to be attracted to said template surface so as to conform to said selected pattern.

39. A system in accordance with claim 22 wherein said template means includes means for retaining magnetized particles capable of motion therein;

means for producing a controlled magnetic field operable to move said magnetized particles so as to form a selected pattern thereof in said template means in contact with a surface of said template means so that said surface forms a topographical pattern conforming to said selected pattern of magnetized particles.

40. A system in accordance with claim 38 wherein said material is positioned adjacent said template surface before said medium has been applied to said material.

41. A system in accordance with claim 38 wherein said material is positioned adjacent said template surface after said medium has been applied to said material.

42. A system in accordance with claim 39 wherein said material is positioned adjacent said template surface before said medium has been applied to said material.

43. A system in accordance with claim 39 wherein said material is positioned adjacent said template surface after said medium has been applied to said material.

44. A system in accordance with claim 9 wherein said selected pressure is provided by the weight of said material.

* * * * *